US010661568B2

(12) United States Patent
Camino Salinas et al.

(10) Patent No.: US 10,661,568 B2
(45) Date of Patent: May 26, 2020

(54) PRINTING FLUID DELIVERY SYSTEM FOR PRINTERS

(71) Applicant: Hewlett-Packard Development Company, L.P., Houston, TX (US)

(72) Inventors: Alfonso Camino Salinas, Sant Cugat del Valles (ES); Daniel Gonzalez Perello, Sant Cugat del Valles (ES); Jose Antonio Lopez Abances, Sant Cugat del Valles (ES); Rafael Ulacia Portoles, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/521,553

(22) PCT Filed: Jan. 30, 2015

(86) PCT No.: PCT/US2015/013827
§ 371 (c)(1),
(2) Date: Apr. 24, 2017

(87) PCT Pub. No.: WO2016/122613
PCT Pub. Date: Aug. 4, 2016

(65) Prior Publication Data

US 2017/0313091 A1 Nov. 2, 2017

(51) Int. Cl.
*B41J 2/175* (2006.01)
*B41J 2/155* (2006.01)

(52) U.S. Cl.
CPC ..... *B41J 2/175* (2013.01); *B41J 2/155* (2013.01); *B41J 2/17513* (2013.01); *B41J 2/17533* (2013.01)

(58) Field of Classification Search
CPC ..... B41J 2/155; B41J 2/175
See application file for complete search history.

(56) References Cited

U.S. PATENT DOCUMENTS

| | | | | |
|---|---|---|---|---|
| 5,992,990 | A | 11/1999 | Childers et al. | |
| 6,206,512 | B1 | 3/2001 | Gasso et al. | |
| 6,220,701 | B1 * | 4/2001 | Umemura | B41J 2/17513 347/86 |
| 6,231,173 | B1 | 5/2001 | Pawlowski et al. | |
| 6,565,193 | B1 | 5/2003 | Silverbrook et al. | |
| 6,779,875 | B2 | 8/2004 | Pawlowski et al. | |
| 7,246,881 | B2 | 7/2007 | Silverbrook | |
| 7,284,826 | B2 | 10/2007 | Silverbrook | |
| 7,673,966 | B2 | 3/2010 | Foote et al. | |
| 7,712,868 | B2 | 5/2010 | Silverbrook et al. | |
| 7,726,785 | B2 | 6/2010 | Silverbrook et al. | |

(Continued)

FOREIGN PATENT DOCUMENTS

| | | |
|---|---|---|
| AU | 2004210577 | 9/2004 |
| CN | 1371321 | 9/2002 |

(Continued)

*Primary Examiner* — Alessandro V Amari
*Assistant Examiner* — Kendrick X Liu

(57) ABSTRACT

In one example, a printing fluid delivery system for a printer is described. The printing fluid delivery system includes a plurality of interconnected printing fluid supply modules forming a page-wide printing fluid manifold to supply printing fluid from one or more cartridges to one or more printheads along a print bar in a printer.

17 Claims, 7 Drawing Sheets

(56) References Cited

U.S. PATENT DOCUMENTS

| | | | | |
|---|---|---|---|---|
| 8,096,640 | B2 | 1/2012 | Blair et al. | |
| 8,172,376 | B2 | 5/2012 | Nathan et al. | |
| 8,342,644 | B2 | 1/2013 | Yoshimura | |
| 2005/0157054 | A1* | 7/2005 | Silverbrook | B41J 2/155 347/42 |
| 2007/0139468 | A1 | 6/2007 | Schulmeister | |
| 2008/0062221 | A1* | 3/2008 | Silverbrook | B41J 2/155 347/32 |
| 2008/0246808 | A1 | 10/2008 | Silverbrook et al. | |
| 2009/0128607 | A1 | 5/2009 | Schmitt | |
| 2010/0220161 | A1 | 9/2010 | Silverbrook et al. | |
| 2010/0302311 | A1 | 12/2010 | Blair et al. | |

FOREIGN PATENT DOCUMENTS

| | | |
|---|---|---|
| CN | 1906040 | 1/2007 |
| CN | 103129131 | 6/2013 |
| GB | 2520745 | 6/2015 |
| JP | 2007-203528 | 8/2007 |
| JP | 2009-279940 | 12/2009 |
| JP | 2012-011561 | 1/2012 |
| WO | WO-2014149037 | 9/2014 |

* cited by examiner

PRINTING FLUID DELIVERY SYSTEM FOR PRINTERS

BACKGROUND

In printing apparatuses, one or more printheads may be organized at least substantially perpendicular to the direction of movement of media sheets or may be moved substantially perpendicular to the media sheets. The one or more printheads may be organized, in that the one or more printheads may extend from one side or edge of the media sheets to the other side or edge of the media sheets. Further, the printheads may include nozzles to eject printing fluid onto the media sheets to create an image. Such printers include printing fluid reservoirs or sources of printing fluid that may be located off-axis and may provide printing fluid to the printheads through tubing extended between the printing fluid reservoir and the printheads.

DETAILED DESCRIPTION

Figure 1:
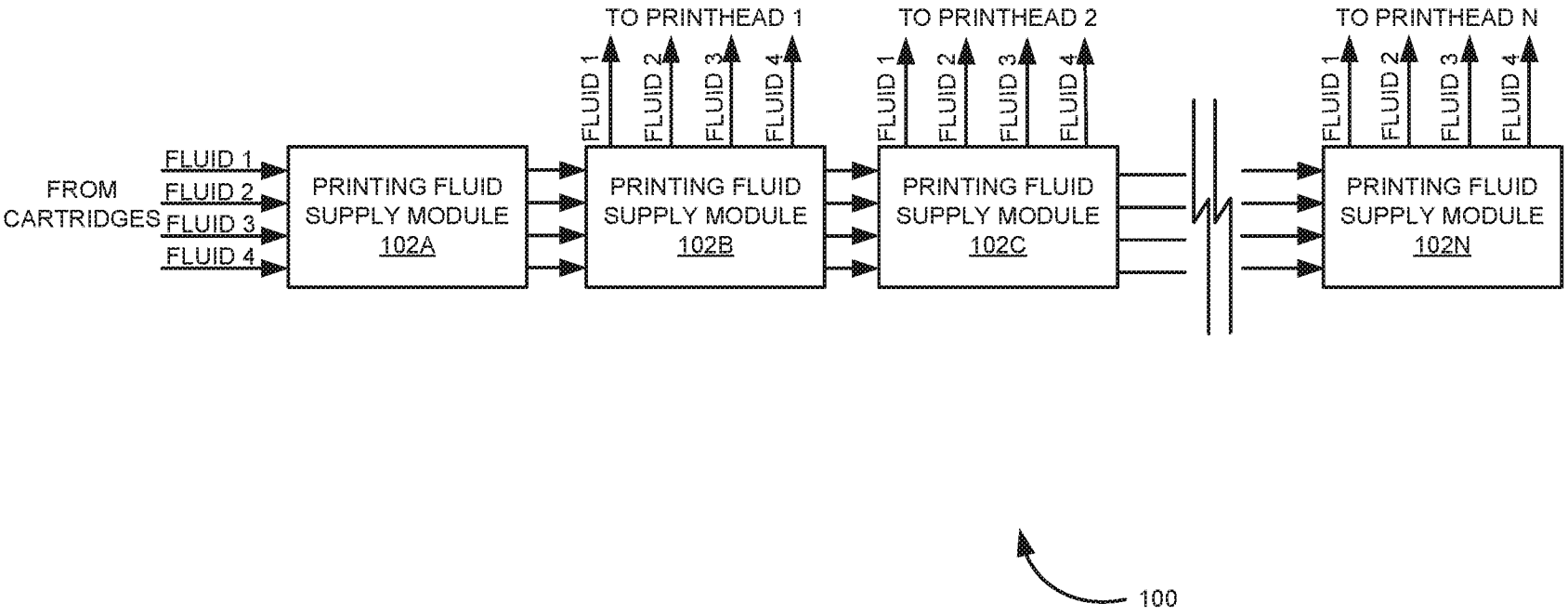
FIG. 1 is a block diagram illustrating an example printing fluid delivery system.

In the following detailed description of the examples of the present subject matter, references are made to the accompanying drawings that form a part hereof, and in which are shown by way of illustration specific examples in which the present subject matter may be practiced. These examples are described in sufficient detail to enable those skilled in the art to practice the present subject matter, and it is to be understood that other examples may be utilized and that changes may be made without departing from the scope of the present subject matter. The following detailed description is, therefore, not to be taken in a limiting sense, and the scope of the present subject matter is defined by the appended claims.

In the following description and figures, some example implementations of modular printing fluid delivery system for printers, for instance page-wide array printers, 3D printers and the like, are described. The printers include printheads that may extend from one side or edge of media sheets to the other side or edge of the media sheets or a single printhead that may have nozzles that span the width of the media sheets. The printheads are stacked together on a print bar to provide a compact print zone. Further, the printheads include a plurality of nozzles which eject printing fluid onto the media sheets. The printheads may receive the printing fluid from a printing fluid supply source such as cartridges. The printing fluid supply source may include one or more reservoirs for storing the printing fluid. For instance, the printing fluid includes inks, varnishes, post/pre treatments, and/or 3D printing agents. The printing fluid supply source may be located separately from the printheads and may need to deliver the printing fluid to the printheads along the print bar.

Various examples described below relate to a printing fluid delivery system that includes interconnected printing fluid supply modules forming a page-wide printing fluid manifold to supply the printing fluid from the printing fluid supply source to at least one printhead along the print bar in printers, such as page-wide array printers, 3D printers, or other printers having page-wide array arrangement. The printing fluid supply modules are arranged or connected to each other to build pipelines from the cartridges to the at least one printhead. In one example, the printing fluid supply modules include pass-through channels which can be connected to form the page-wide printing fluid manifold. Also, the printing fluid supply modules provide a fluid interface with the at least one printhead. For example, the printing fluid supply modules are arranged to build pipelines from the cartridges to the nozzles that span the width of the media sheets in one or more printheads. For purposes of this disclosure, the term "fluid interface" refers to passage of fluid to the nozzles and/or printheads. This type of arrangement of the printing fluid supply modules can provide a scalable, flexible, easily serviceable and replaceable printing fluid delivery system.

FIG. 1 is a block diagram illustrating an example printing fluid delivery system 100. Referring to FIG. 1, the printing fluid delivery system 100 includes multiple printing fluid supply modules 102A-N having pass-through channels. In one example, the printing fluid supply modules 102A-N are interconnected to form a page-wide printing fluid manifold to supply printing fluid (e.g., fluids 1, 2, 3, and 4) from one or more cartridges to an array of printheads (e.g., printheads 1-N) along a print bar in a page-wide array printer or a 3D printer. For instance, the printing fluid includes inks, varnishes, post/pre treatments, 3D printing agents, and the like. In the example shown in FIG. 1, the pass-through channels within the page-wide printing fluid manifold may route various printing fluids (e.g., fluids 1, 2, 3, and 4) of same and/or different color to the array of printheads in the print bar. Further, the printheads are responsive to activation signals from the page-wide array printer or 3D printer to deposit the printing fluid on a print sheet to thereby print on the print sheet.

Figure 2:
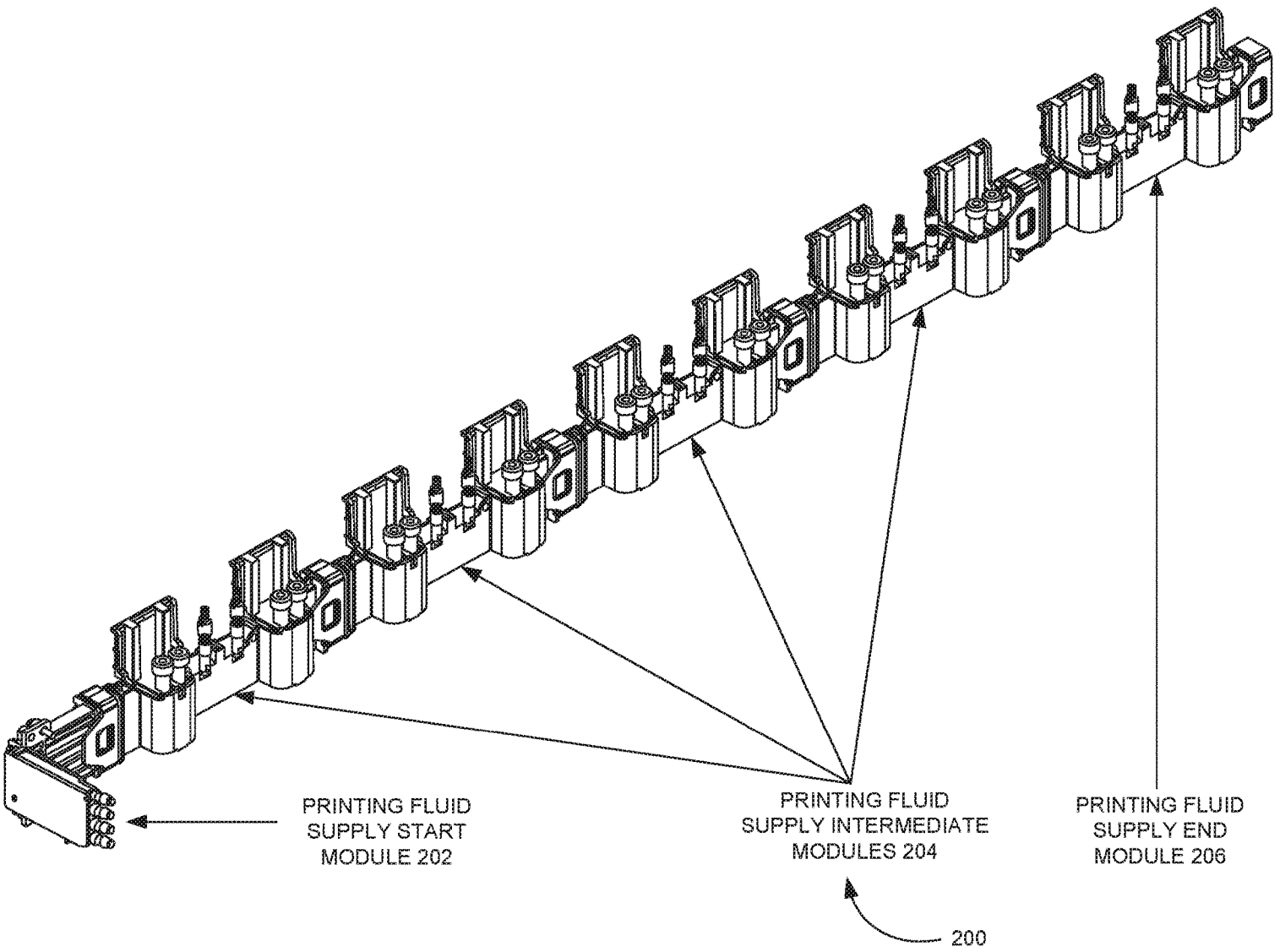
FIG. 2 is a diagram illustrating an example printing fluid delivery system.

FIG. 2 is a diagram illustrating an example printing fluid delivery system 200. Referring to FIG. 2, the example printing fluid delivery system 200 includes a printing fluid supply start module 202, a printing fluid supply end module 206, and printing fluid supply intermediate modules 204 that are serially connected between the printing fluid supply start module 202 and the printing fluid supply end module 206. For example, the printing fluid supply intermediate modules 204 are connected to each other in series such that a first printing fluid supply intermediate module is connected to the printing fluid supply start module 202 and a last printing fluid supply intermediate module is connected to the printing fluid supply end module 206.

Further, the printing fluid supply start module 202 connects printing fluid channels of the cartridges to the printing fluid supply intermediate modules 204 and the printing fluid supply end module 206 includes a closing to end each printing fluid channel in the page-wide printing fluid manifold. In the example shown in FIG. 2, the printing fluid supply intermediate modules 204 and the printing fluid supply end module 206 provide a fluidic interface with the one or more printheads along the print bar. For example, the printheads may be in fluid communication with cartridges through the page-wide printing fluid manifold of the printing fluid delivery system 200.

For example, the printing fluid supply start module 202 provides a connection of printing fluid lines placed in the print bar which holds the printheads to the printing fluid supply source such as cartridges and provides a fluid interconnection and a mechanical linkage to a next printing fluid supply intermediate module 204 that is connected to the printing fluid supply start module 202. Further, the printing fluid supply intermediate modules 204 provide the fluidic interface with the printheads and hold mechanical keys, such as lockouts, to prevent an insertion of a wrong printhead. Furthermore, the printing fluid supply intermediate modules 204 provide a linkage to other printing fluid supply intermediate modules, the printing fluid supply start module 202, and/or the printing fluid supply end module 206.

In the example shown in FIG. 2, the printing fluid delivery system 200 is formed using multiple printing fluid supply intermediate modules 204 connected between the printing fluid supply start module 202 and the printing fluid supply end module 206, however, the printing fluid delivery system 200 can also be formed using a single printing fluid supply intermediate module connected between the printing fluid supply start module 202 and the printing fluid supply end module 206 or by connecting the printing fluid supply start module 202 to the printing fluid supply end module 206.

Even though, the array of printheads is described as including multiple printheads, the array of printheads can include a single printhead that may have nozzles that span the width of the media sheets. In one example, when the array of printheads includes a single printhead, the printing fluid delivery system can include a printing fluid supply start module and a printing fluid supply end module connected to the printing fluid supply start module, the printing fluid supply end module provides a fluidic interface with the nozzles of the single printhead along the print bar. In another example, when the array of printheads includes a single printhead, the printing fluid delivery system can include multiple printing fluid supply modules providing a fluidic interface with the nozzles of the single printhead along the print bar. In this case, the number of printing fluid supply intermediate modules 204 in the printing fluid delivery system 200 depends on the width of the print bar in the printer. This scalable design may allow print bars of different widths to be built by stacking together printheads and printing fluid supply modules. Also, the printing fluid supply end module 206 may be similar to that of the printing fluid supply intermediate modules 204, however, the printing fluid supply end module 206 includes dead ends to end the printing fluid channels in the printing fluid delivery system, i.e., no fluidic interface with subsequent printing fluid supply modules. An example design of a printing fluid supply intermediate module is shown in FIG. 3.

Figure 3:
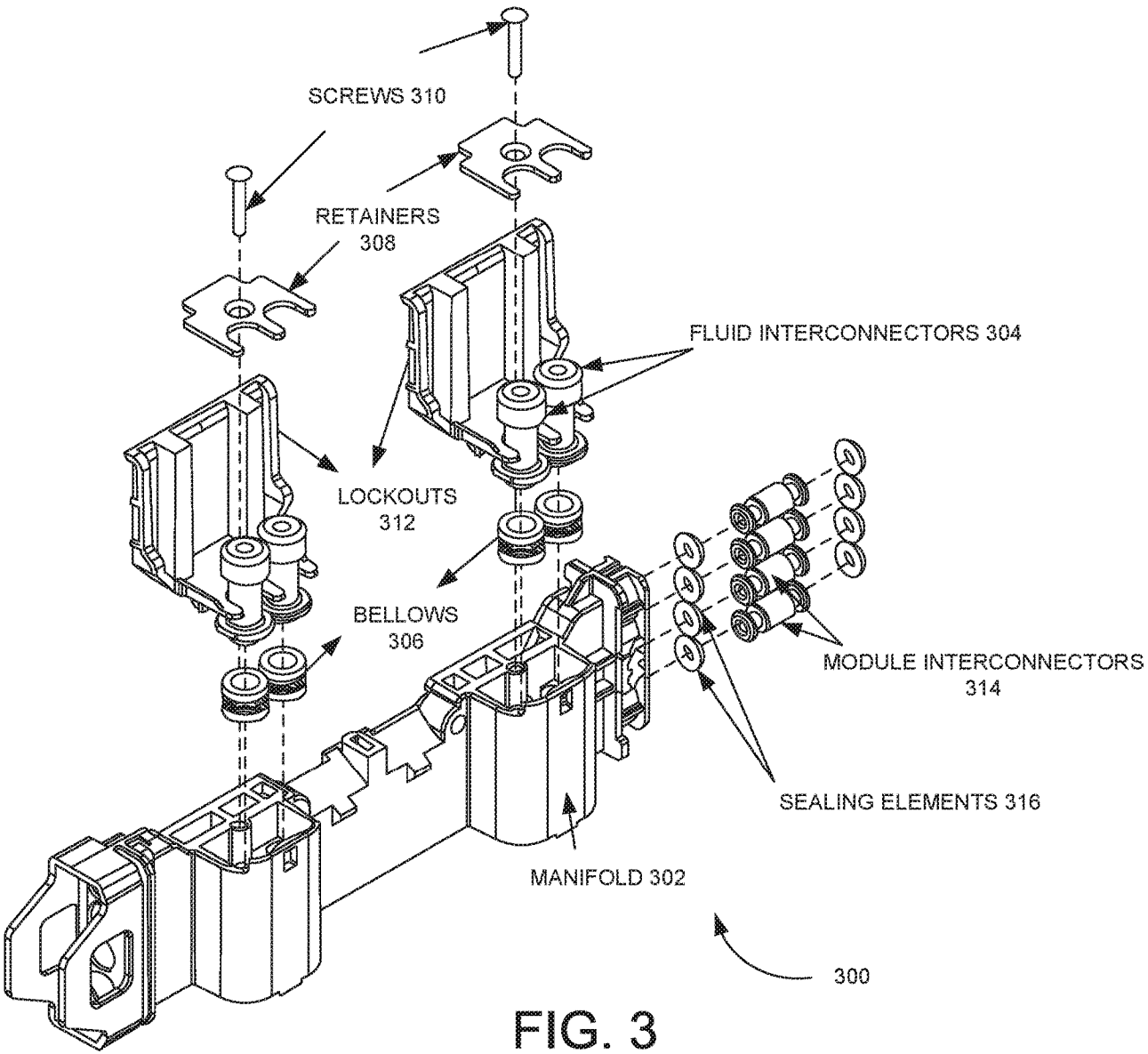
FIG. 3 is an exploded view of an example printing fluid supply intermediate module of the example printing fluid delivery system of FIG. 2.

FIG. 3 is an exploded view of an example printing fluid supply intermediate module 300, such as one of the printing fluid supply intermediate modules 204 of FIG. 2. Referring to FIG. 3, the example printing fluid supply intermediate module 300 includes a manifold 302 to materialize printing fluid channels, in which the printing fluid flows through. Each printing fluid channel in the manifold 302 may be formed by a pass-through channel and a derivation driving a fraction of printing fluid flow rate to the array of printheads. In the example shown in FIG. 3, the manifold 302 can be made in two parts (e.g., a body and a lid), that may be glued, welded or joint by another process, to form a closed pass-through channel.

Further, the example printing fluid supply intermediate module 300 includes a fluid interconnector 304 corresponding to each printing fluid channel to provide the fluid interface with the array of printheads. In one example, each fluid interconnector 304 provides a fluid interface with each color of the printhead. Each fluid interconnector 304 may be connected to the manifold 302 via an elastic joint referred to as bellows 306. Furthermore, the example printing fluid supply intermediate module 300 includes one or more retainers 308 to hold the fluid interconnectors 304 and screws 310 for joining the retainers 308 to the manifold 302. Also, the example printing fluid supply intermediate module 300 includes lockouts 312 to prevent printheads with different configurations to make a fluid interconnection. For example, a lockout 312 may act as a key to prevent printheads with other key configurations to make a fluid interconnection.

Furthermore, the example printing fluid supply intermediate module 300 includes a module interconnector 314 corresponding to each printing fluid channel to connect each printing fluid channel between the interconnected printing fluid supply modules. Module interconnectors 314 connect each printing fluid line of one printing fluid supply module with a next or previous printing fluid supply module. Each module interconnector includes sealing elements 316 (e.g., o-shaped rings) to seal the printing fluid channel between the plurality of interconnected printing fluid supply modules. For example, the sealing elements 316 seals printing fluid channels on both sides of the module interconnectors 314 (i.e., seals printing fluid channels of the printing fluid supply intermediate module 300 and a printing fluid channel of a next or previous printing fluid supply module).

FIG. 3 shows a construction of one example printing fluid supply intermediate module 300. In one example, the interconnection parts (e.g., the module interconnectors 314, the fluid interconnectors 304 and the like) shown in the printing fluid supply intermediate module 300 may be similar to the interconnection parts of the printing fluid supply start module and printing fluid supply end module, however the printing fluid supply start module may not have fluidic interface with the printheads and the printing fluid supply end module may not have fluidic interface with subsequent printing fluid supply modules.

Figure 4:
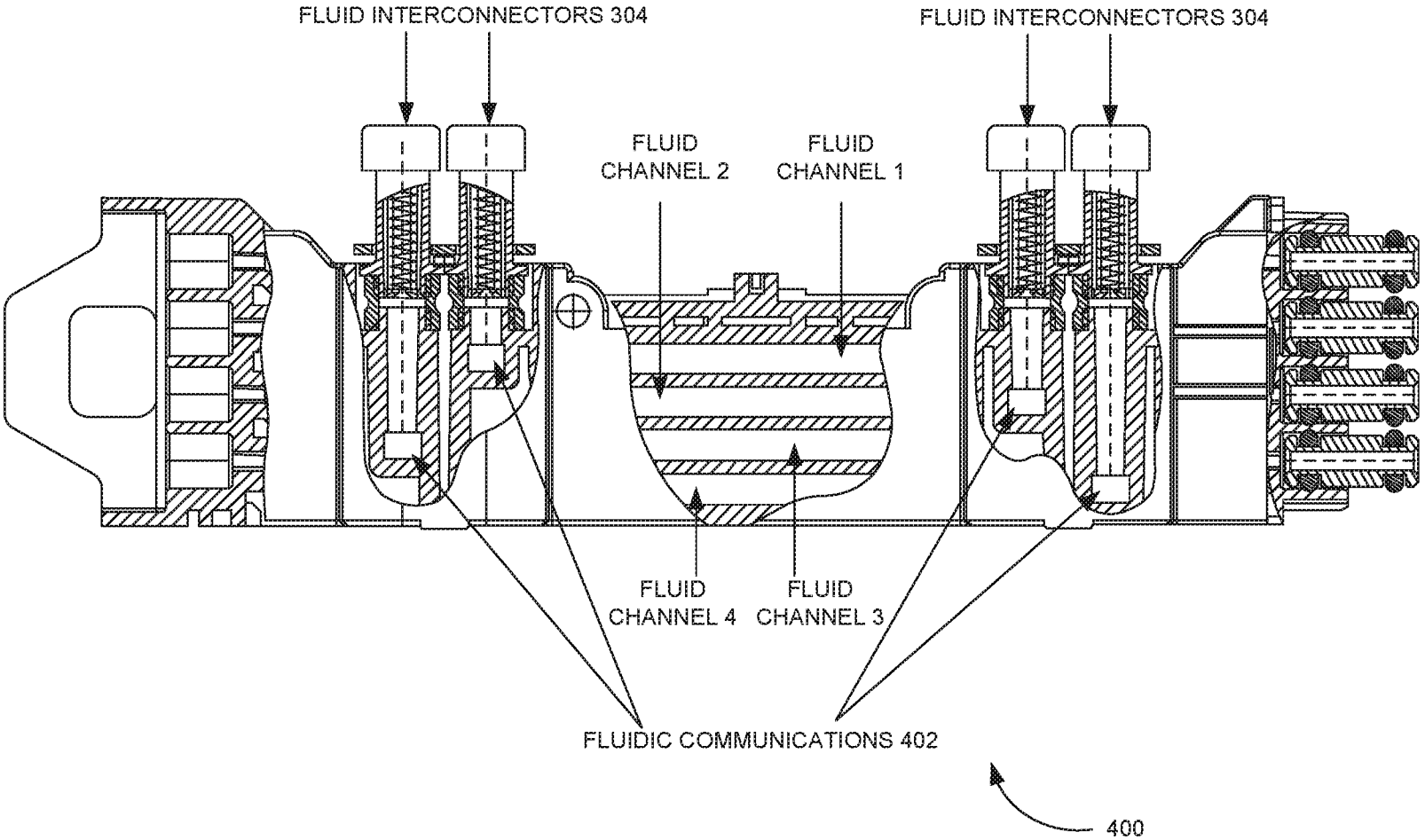
FIG. 4 is a partial cross-sectional view of the example printing fluid supply intermediate module depicting printing fluid channels.

FIG. 4 is a partial cross-sectional view of the example printing fluid supply intermediate module 400 (e.g., printing fluid supply intermediate module 300 of FIG. 3), depicting printing fluid channels (e.g., fluid channels 1, 2, 3, and 4). FIG. 4 also shows a fluidic communication 402 of each fluid interconnector 304 with a respective one of the fluid channels 1, 2, 3 and 4.

Figure 5:
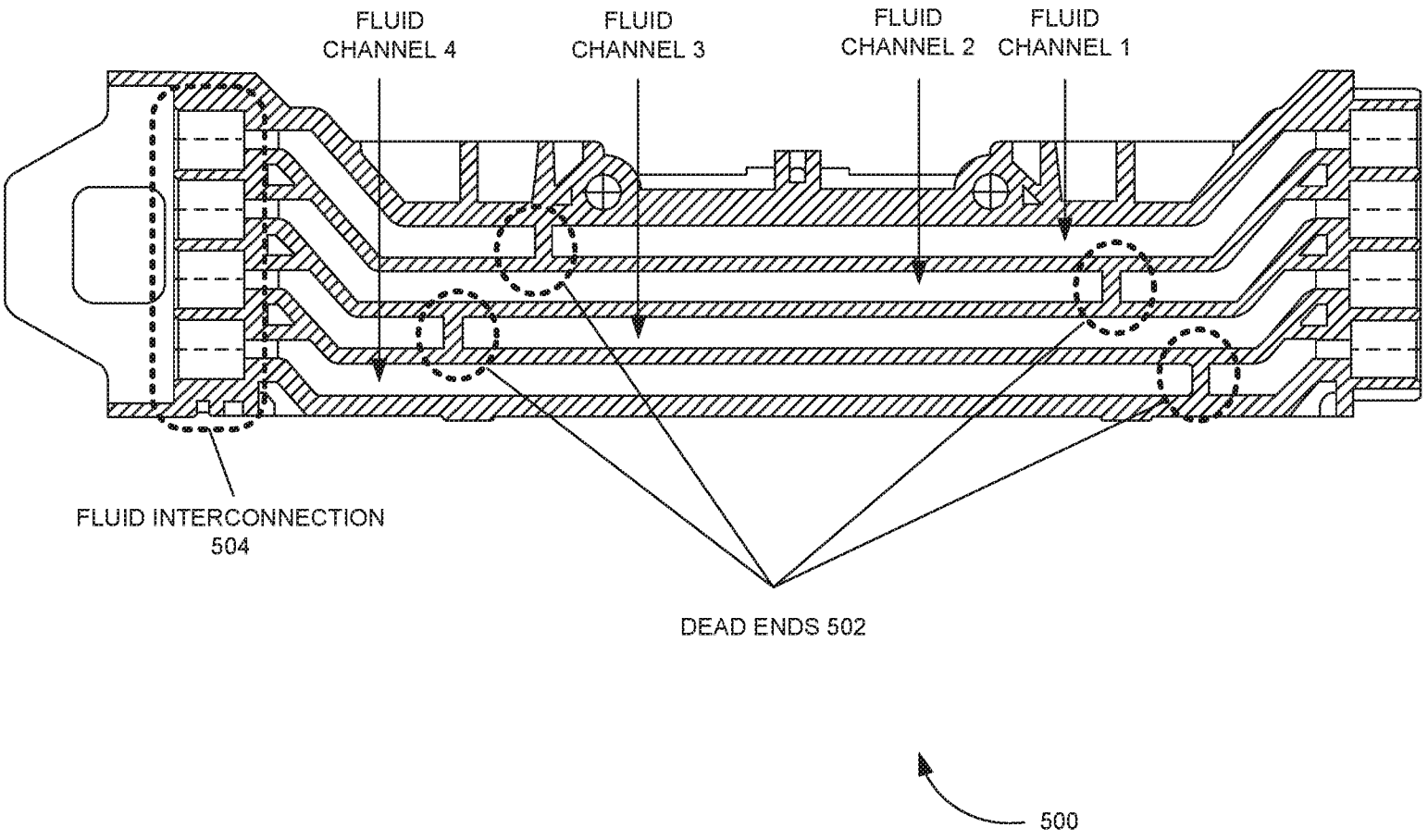
FIG. 5 is a cross-sectional view of an example printing fluid supply end module depicting end of printing fluid channels.

FIG. 5 is a cross-sectional view of an example printing fluid supply end module 500 (e.g., printing fluid supply end module 206 of FIG. 2), depicting end of printing fluid channels (e.g., fluid channels 1, 2, 3, and 4). Particularly, FIG. 5 shows dead ends 502 for each printing fluid channel inside the printing fluid supply end module 500. FIG. 5 also illustrates fluid interconnection 504 of the printing fluid supply end module 500 with a previous printing fluid supply intermediate module. In one example, the interconnection parts for fluidic interface with the printheads in the printing fluid supply end module 500 may be similar to the interconnection parts of the printing fluid supply intermediate modules.

Figure 6:
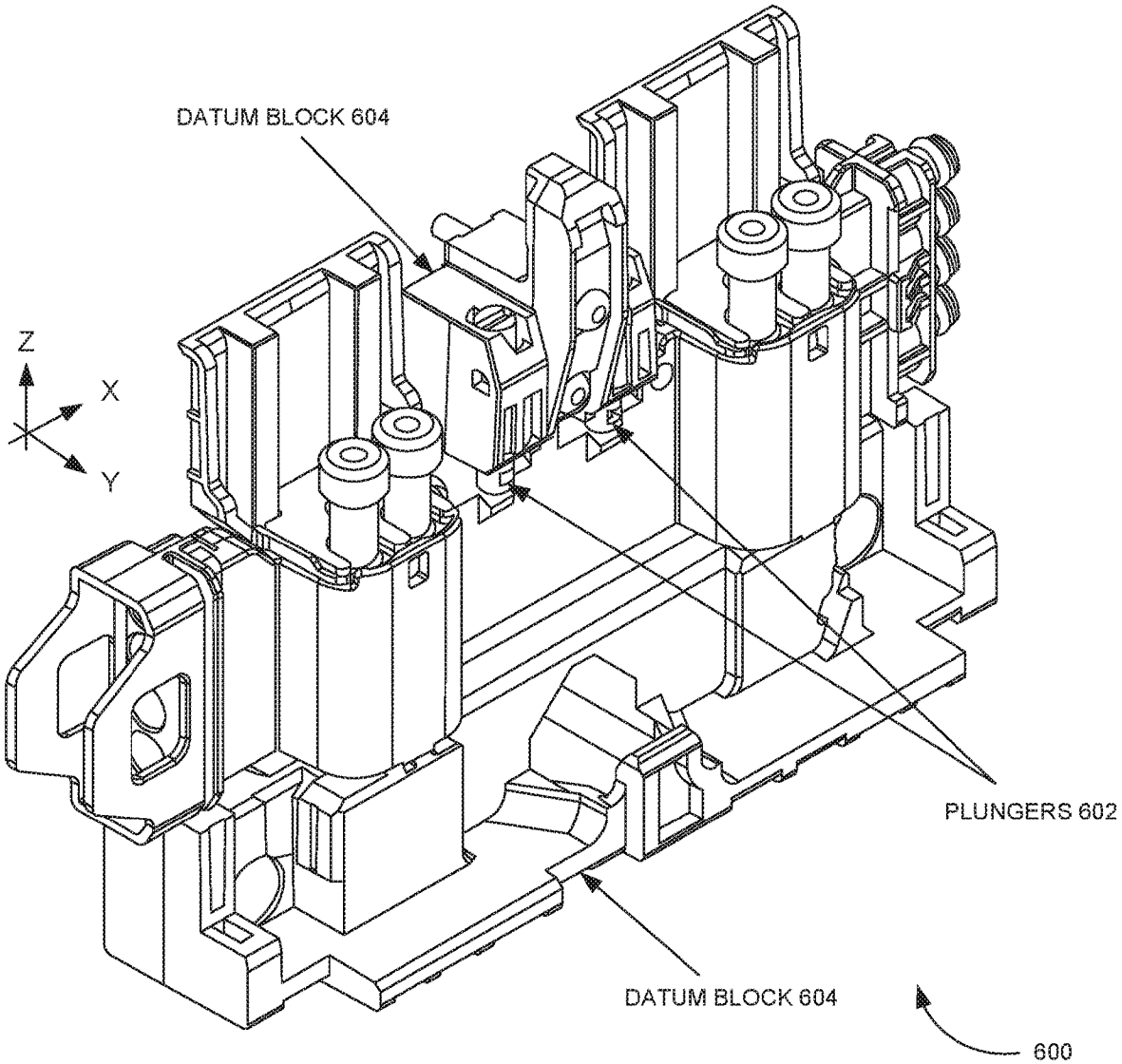
FIG. 6 is a diagram illustrating an example printing fluid supply intermediate module with plungers.

FIG. 6 is a diagram illustrating an example printing fluid supply module 600, such as the printing fluid supply intermediate module 204 and/or printing fluid supply end module 206 of FIG. 2, with plungers 602. The plungers may be used to apply force on manifold surface, which forces datums of the printing fluid supply module 600 to touch corresponding datums in the printer. FIG. 6 shows an example of how a printing fluid supply module 600 is referenced in the printer. The datum parts in the printer may be referred to as datum blocks 604, and provide the datums to the printheads, which may provide a chain of tolerances between the printing fluid supply module 600 and the printhead.

For example, plunger 602 is a device used to apply a force over manifold faces to position the printing fluid supply module 600 in the printer in Z (height) and Y (paper advance) direction, which forces the datums of the printing fluid supply module 600 to touch the corresponding datums in the printer. The X reference may be done with a conventional system (e.g., a pin in the manifold centered in a groove in the printer datum part). Further, the array of printing fluid supply modules can be removed from the printer by removing the plungers, and moving out the array of printing fluid supply modules in Y direction.

Figure 7:
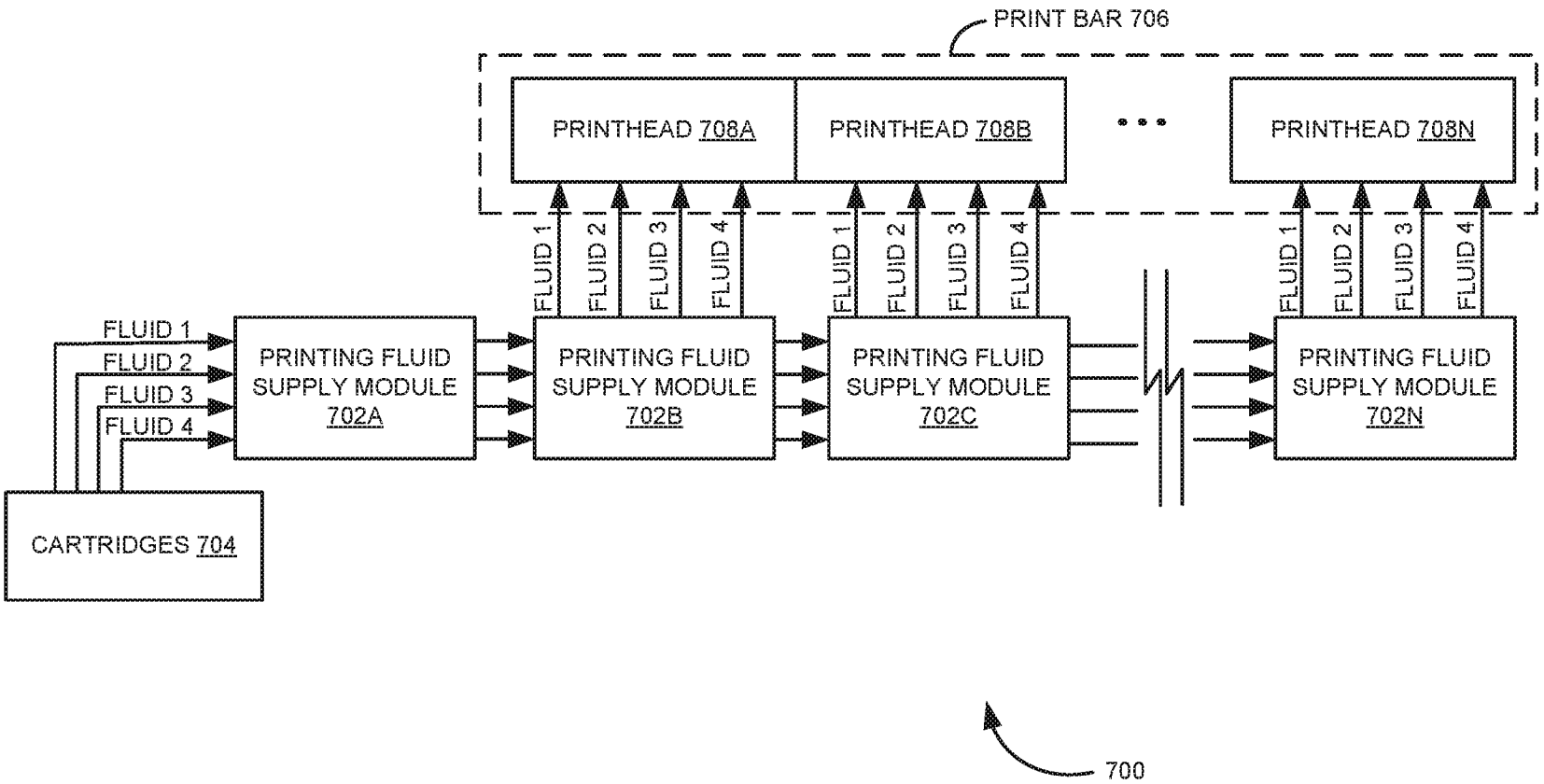
FIG. 7 is a block diagram of an example printer.

FIG. 7 is a block diagram of an example printing apparatus/printer 700 (e.g., page-wide array printer, 3D printer and the like). The printer 700 includes at least one cartridge 704, a print bar 706 including one or more printheads 708A-N, and interconnected printing fluid supply modules 702A-N connected to a respective printhead of the array of printheads 708A-N. The interconnected printing fluid supply modules 702A-N forms a page-wide printing fluid manifold to supply printing fluid (e.g., fluids 1, 2, 3, and 4) from the cartridges 704 to the array of printheads 708A-N. Each of the printheads comprises multiple printing fluid nozzles to print on a print sheet. Even though, FIG. 7 depicts each printing fluid supply module as connected to one printhead of the array of printheads, multiple printing fluid supply modules can also be connected to one printhead depending on the width of the printhead.

In the example shown in FIG. 7, the printing fluid supply module 702A is a printing fluid supply start module, the printing fluid supply module 702N is a printing fluid supply end module, and printing fluid supply intermediate modules (702B, 702C, and so on) are serially connected between the printing fluid supply start module and the printing fluid supply end module. In one example, the printing fluid supply modules 702B-N provides a fluidic interface with a respective one of the printheads 708A-N along the print bar 706 (as shown in FIG. 7). In another example, the interconnected printing fluid supply modules 702A-N can provide a fluidic interface with the array of printheads 708A-N along the print bar.

The printing fluid supply start module 702A connects each printing fluid channel of the cartridges 704 to the printing fluid supply intermediate module 702B, and the printing fluid supply end module 702N includes a closing to end each printing fluid channel in the page-wide printing fluid manifold. This arrangement enables scaling of the print bar into different widths by addition or removal of one or more interconnected printing fluid supply intermediate modules and corresponding printheads.

The apparatus or system described through FIGS. 1-7 may provide a modular and flexible configuration of printing fluid delivery system. Further, the interconnection of printing fluid supply modules enables compliancy of mechanical tolerances, and compliancy to the differential thermal expansion between the print bar beam and the printing fluid channels. The apparatus or system described through FIGS. 1-7 may enable easy servicing and replacing of the printing fluid supply start modules in the printing fluid delivery system.

The terms "include," "have," and variations thereof, as used herein, have the same meaning as the term "comprise" or appropriate variation thereof. Furthermore, the term "based on", as used herein, means "based at least in part on." Thus, a feature that is described as based on some stimulus can be based on the stimulus or a combination of stimuli including the stimulus.

The present description has been shown and described with reference to the foregoing examples. It is understood, however, that other forms, details, and examples can be made without departing from the spirit and scope of the present subject matter that is defined in the following claims.

What is claimed is:

1. A printing fluid delivery system, comprising:

a plurality of interconnected printing fluid supply modules forming a page-wide printing fluid manifold to supply printing fluid from at least one cartridge to at least one printhead along a print bar in a printer, wherein at least one printing fluid supply module of the plurality of interconnected printing fluid supply modules provides a fluidic interface with a respective printhead of the at least one printhead along the print bar, and wherein the plurality of interconnected printing fluid supply modules comprises:

a printing fluid supply start module;

a printing fluid supply end module; and at least one printing fluid supply intermediate module serially connected between the printing fluid supply start module and the printing fluid supply end module, wherein the at least one printing fluid supply intermediate module includes at least one lockout to prevent printheads of the at least one printhead with different configurations from making a fluid interconnection with the at least one printing fluid supply intermediate module, and wherein the at least one lockout further includes a retainer to hold at least one connector for providing the fluidic interface with the respective printhead.

2. The printing fluid delivery system of claim 1, wherein the at least one cartridge comprises a plurality of printing fluid channels, wherein the printing fluid supply start module connects each printing fluid channel of the plurality of printing fluid channels to the at least one printing fluid supply intermediate module, and wherein the printing fluid supply end module comprises a dead end to end each printing fluid channel in the page-wide printing fluid manifold.

3. The printing fluid delivery system of claim 1, wherein each of the printing fluid supply end module and the at least one printing fluid supply intermediate module comprises:

a manifold to materialize printing fluid channels, wherein each printing fluid channel in the manifold is formed by a pass-through channel and a derivation driving a fraction of printing fluid flow rate to the at least one printhead.

4. The printing fluid delivery system of claim 1, wherein each of the printing fluid supply end module and the at least one printing fluid supply intermediate module comprises:

a fluid interconnector corresponding to each printing fluid channel of the at least one cartridge to provide the fluidic interface with the at least one printhead.

5. The printing fluid delivery system of claim 1, wherein each of the plurality of interconnected printing fluid supply modules comprises:

a module interconnector corresponding to each printing fluid channel of the at least one cartridge to connect each printing fluid channel between the plurality of interconnected printing fluid supply modules; and a sealing element to seal each printing fluid channel between the plurality of interconnected printing fluid supply modules.

6. The printing fluid delivery system of claim 1, wherein each of the printing fluid supply end module and the at least one printing fluid supply intermediate module comprises:

at least one plunger to apply force on manifold surface, which forces datums of the plurality of interconnected printing fluid supply modules to touch corresponding datums in the printer.

7. The printing fluid delivery system of claim 1, wherein each printing fluid supply module of the plurality of interconnected printing fluid supply modules is removable from the printing fluid delivery system.

8. The printing fluid delivery system of claim 1, wherein the fluidic interface provides for passage of fluid from the at least one printing fluid supply module to the at least one printhead.

9. The printing fluid delivery system of claim 1, wherein the at least one lockout comprises a first lockout and a second lockout, wherein the retainer of the first lockout holds the connector for making the fluid interconnection with a first printing fluid color of the at least one printhead, and the retainer of the second lockout holds a connector for making the fluid interconnection with a second printing fluid color of the at least one printhead.

10. The printing fluid delivery system of claim 9, further comprising:

a plurality of printing fluid channels positioned between the first lockout and the second lockout.

11. A printing apparatus, comprising:

a print bar comprising:

at least one printhead; and a plurality of interconnected printing fluid supply modules connected to the at least one printhead, wherein the plurality of interconnected printing fluid supply modules forms a page-wide printing fluid manifold to supply printing fluid from at least one cartridge to the at least one printhead, wherein at least one printing fluid supply module of the plurality of interconnected printing fluid supply modules provides a fluidic interface with a respective printhead of the at least one printhead along the print bar, and wherein the plurality of interconnected printing fluid supply modules comprises:

a printing fluid supply start module;

a printing fluid supply end module; and at least one printing fluid supply intermediate module serially connected between the printing fluid supply start module and the printing fluid supply end module, wherein the at least one printing fluid supply intermediate module includes at least one lockout to prevent printheads of the at least one printhead with different configurations from making a fluid interconnection with the at least one printing fluid supply intermediate module, and wherein the at least one lockout further includes a retainer to hold at least one connector for providing the fluidic interface with the respective printhead.

12. The printing apparatus of claim 11, wherein the at least one cartridge comprises a plurality of printing fluid channels, wherein the printing fluid supply start module connects each printing fluid channel of the plurality of printing fluid channels to the at least one printing fluid supply intermediate module, and wherein the printing fluid supply end module comprises a dead end to end each printing fluid channel in the page-wide printing fluid manifold.

13. The printing apparatus of claim 11, wherein the print bar is scalable by addition or removal of at least one interconnected printing fluid supply module.

14. The printing apparatus of claim 11, wherein the fluidic interface provides for passage of fluid from the at least one printing fluid supply module to the at least one printhead.

15. A printing fluid delivery system, comprising:

a printing fluid supply start module;

a printing fluid supply end module; and at least one printing fluid supply intermediate module serially connected between the printing fluid supply start module and the printing fluid supply end module, wherein each of the at least one printing fluid supply intermediate module and the printing fluid supply end module provides a fluidic interface with a respective printhead of the at least one printhead along a print bar in a printer, and wherein the at least one printing fluid supply module includes at least one lockout to prevent printheads of the at least one printhead with different configurations from making a fluid interconnection with the at least one printing fluid supply intermediate module, and wherein the at least one lockout further includes a retainer to hold at least one connector for providing the fluidic interface with the respective printhead, and wherein the printing fluid supply start module, the printing fluid supply end module, and the at least one printing fluid supply intermediate module collectively form a page-wide printing fluid manifold to supply printing fluid from at least one cartridge to the at least one printhead.

16. The printing fluid delivery system of claim 15, wherein the fluidic interface provides for passage of fluid from the each of the at least one printing fluid supply intermediate module and the printing fluid supply end module to the at least one printhead.

17. The printing fluid delivery system of claim 16, wherein each printing fluid supply module of the printing fluid supply start module, the printing fluid supply end module, and the at least one printing fluid supply intermediate module is removable from the printing fluid delivery system.

* * * * *